US011605322B2

(12) United States Patent
Yu et al.

(10) Patent No.: US 11,605,322 B2
(45) Date of Patent: Mar. 14, 2023

(54) PIXEL CIRCUIT, DRIVING METHOD THEREOF AND DISPLAY DEVICE

(71) Applicants: CHENGDU BOE OPTOELECTRONICS TECHNOLOGY CO., LTD., Sichuan (CN); BOE TECHNOLOGY GROUP CO., LTD., Beijing (CN)

(72) Inventors: Ziyang Yu, Beijing (CN); Zhu Wang, Beijing (CN); Weiqing Li, Beijing (CN); Qian Hu, Beijing (CN)

(73) Assignees: CHENGDU BOE OPTOELECTRONICS TECHNOLOGY CO., LTD., Sichuan (CN); BOE TECHNOLOGY GROUP CO., LTD., Beijing (CN)

( * ) Notice: Subject to any disclaimer, the term of this patent is extended or adjusted under 35 U.S.C. 154(b) by 164 days.

(21) Appl. No.: 17/309,815

(22) PCT Filed: Dec. 29, 2020

(86) PCT No.: PCT/CN2020/140568
§ 371 (c)(1),
(2) Date: Jun. 21, 2021

(87) PCT Pub. No.: WO2021/184897
PCT Pub. Date: Sep. 23, 2021

(65) Prior Publication Data

US 2022/0309970 A1 Sep. 29, 2022

(30) Foreign Application Priority Data

Mar. 18, 2020 (CN) ..... 202010190959.1

(51) Int. Cl.
*G09G 3/3291* (2016.01)
*G09G 3/00* (2006.01)
*G09G 3/3266* (2016.01)

(52) U.S. Cl.
CPC ..... *G09G 3/006* (2013.01); *G09G 3/3266* (2013.01); *G09G 3/3291* (2013.01);
(Continued)

(58) Field of Classification Search
CPC ..... G09G 3/32; G09G 3/3208; G09G 3/3225; G09G 3/3233; G09G 3/3258;
(Continued)

(56) References Cited

U.S. PATENT DOCUMENTS 10,629,120 B2 * 4/2020 Zhou ..... G09G 3/3208
11,302,266 B2 * 4/2022 Jung ..... G09G 3/2092
(Continued)

FOREIGN PATENT DOCUMENTS

CN 103366675 A 10/2013
CN 106504703 A 3/2017
(Continued)

OTHER PUBLICATIONS

The First Office Action dated Nov. 3, 2020 corresponding to Chinese application No. 202010190959.1.

*Primary Examiner* — Michael J Eurice
(74) *Attorney, Agent, or Firm* — Nath, Goldberg & Meyer; Joshua B. Goldberg

(57) ABSTRACT

Pixel circuit, driving method thereof and display device are provided. Pixel circuit includes driving transistor, storage capacitor, voltage-stabilizing capacitor, data writing sub-circuit, threshold compensation sub-circuit, reset sub-circuit, sensing sub-circuit and light-emitting control sub-circuit. First terminal of storage capacitor, gate electrode of driving transistor, first terminal of reset sub-circuit and first
(Continued)

terminal of threshold compensation sub-circuit are coupled to first node. Second terminal of storage capacitor, first terminal of sensing sub-circuit and first electrode of light-emitting device are coupled to second node. Sensing sub-circuit is configured to transmit initial voltage signal on reference line to second node during reset sub-periods of sensing period and display period; and transmit voltage at second node to reference line during light-emitting sub-period of sensing period to read voltage at second node. Threshold compensation sub-circuit is configured to write threshold voltage of driving transistor into storage capacitor in response to control of scan line.

20 Claims, 11 Drawing Sheets

(52) U.S. Cl.
CPC ..... *G09G 2300/0426* (2013.01); *G09G 2300/0876* (2013.01); *G09G 2330/12* (2013.01)

(58) Field of Classification Search
CPC .... G09G 3/3266; G09G 3/3291; G09G 3/006; G09G 2300/0426; G09G 2300/0819; G09G 2300/0842; G09G 2300/0852; G09G 2300/0876; G09G 2310/0216; G09G 2310/061; G09G 2320/02; G09G 2320/0233; G09G 2320/0295; G09G 2320/04; G09G 2320/045; G09G 2330/12
See application file for complete search history.

(56) References Cited

U.S. PATENT DOCUMENTS

| | | | | |
|---|---|---|---|---|
| 2018/0211601 | A1* | 7/2018 | Chen | G09G 3/3258 |
| 2018/0277037 | A1* | 9/2018 | Lin | G09G 3/325 |
| 2019/0019455 | A1* | 1/2019 | Chen | G09G 3/3258 |
| 2020/0243012 | A1* | 7/2020 | Jin | H01L 27/1225 |
| 2021/0313415 | A1* | 10/2021 | Ma | H01L 27/3279 |

FOREIGN PATENT DOCUMENTS

| | | | |
|---|---|---|---|
| CN | 106981268 | A | 7/2017 |
| CN | 106991965 | A | 7/2017 |
| CN | 107230452 | A | 10/2017 |
| CN | 107818754 | A | 3/2018 |
| CN | 109003579 | A | 12/2018 |
| CN | 109493806 | A | 3/2019 |
| CN | 109509433 | A | 3/2019 |
| CN | 109727571 | A | 5/2019 |
| CN | 109887466 | A | 6/2019 |
| CN | 110352453 | A | 10/2019 |
| CN | 209843218 | U | 12/2019 |
| CN | 111179855 | A | 5/2020 |

* cited by examiner poly:

PIXEL CIRCUIT, DRIVING METHOD THEREOF AND DISPLAY DEVICE

This is a National Phase Application filed under 35 U.S.C. 371 as a national stage of PCT/CN2020/140568, filed Dec. 29, 2020, an application claiming the benefit of Chinese Application No. 202010190959, filed Mar. 18, 2020, the content of each of which is hereby incorporated by reference in its entirety.

TECHNICAL FIELD

The present disclosure relates to the field of display technologies, and in particular, to a pixel circuit, a driving method thereof and a display device.

BACKGROUND

In an Organic Light-Emitting Diode (OLED) display panel, a difference in threshold voltage may exist due to a manufacture process of a driving transistor in each of the pixel units. Further, the threshold voltage of the driving transistor may drift due to the influence of a temperature and other factors. The difference in the threshold voltages of the driving transistors may also result in an inconsistent emission luminance of the light-emitting device, thereby resulting in unevenness display of the display panel.

SUMMARY

The present disclosure aims to solve at least one of the technical problems existing in the prior art, and provide a pixel circuit, a driving method thereof, and a display device.

As a first aspect, an embodiment of the present disclosure provides a pixel circuit. The pixel circuit includes: a driving transistor, a storage capacitor, a voltage-stabilizing capacitor, a data writing sub-circuit, a threshold compensation sub-circuit, a reset sub-circuit, a sensing sub-circuit, and a light-emitting control sub-circuit.

A first terminal of the storage capacitor, a gate electrode of the driving transistor, a first terminal of the reset sub-circuit, and a first terminal of the threshold compensation sub-circuit are coupled to a first node, and a second terminal of the storage capacitor, a first terminal of the sensing sub-circuit, and a first electrode of the light-emitting device are coupled to a second node.

The reset sub-circuit is configured to transmit a voltage signal on a first power line to the first node in response to control of a reset line.

The sensing sub-circuit is configured to transmit an initial voltage signal on a reference line to the second node in response to control of a sensing line during a reset sub-period of a sensing period and a reset sub-period of a display period; and to transmit a voltage at the second node to the reference line in response to control of the sensing line during a light-emitting sub-period of the sensing period, so as to read the voltage at the second node.

The threshold compensation sub-circuit is configured to electrically couple a first electrode and the gate electrode of the driving transistor in response to control of a scan line, so as to write a threshold voltage of the driving transistor into the storage capacitor.

The data writing sub-circuit is configured to transmit a data signal on a data line to a second electrode of the driving transistor in response to control of the scan line.

The light-emitting control sub-circuit is configured to, in response to control of a light-emitting control line, electrically couple a first electrode of the driving transistor and the first power line, and to electrically couple the second electrode of the driving transistor and the light-emitting device.

Two terminals of the voltage-stabilizing capacitor are respectively coupled to the second node and the scan line.

Each of the data writing sub-circuit, the threshold compensation sub-circuit, the reset sub-circuit, the sensing sub-circuit and the light-emitting control sub-circuit comprises at least one switch transistor. The at least one switch transistor, the driving transistor, the storage capacitor and the voltage-stabilizing capacitor are respectively in a semiconductor layer, a first metal layer, a second metal layer and a third metal layer stacked in sequence, spaced apart and insulated from each other. The first electrode of the light-emitting device is in a fourth metal layer, and the fourth metal layer is on a side of the third metal layer away from the second metal layer.

The storage capacitor includes a first electrode plate and a second electrode plate disposed opposite to each other, and at least a portion of the first electrode plate serves as a portion of the gate electrode of the driving transistor.

The voltage-stabilizing capacitor includes a third electrode plate and a fourth electrode plate disposed opposite to each other, and at least a portion of the third electrode plate is in a same layer as the scan line.

In some embodiments, the pixel circuit further includes a first gate insulation layer, a second gate insulation layer, an interlayer dielectric layer, and a first planarization layer. The first gate insulation layer is between the semiconductor layer and the first metal layer, the second gate insulation layer is between the first metal layer and the second metal layer, the interlayer dielectric layer is between the second metal layer and the third metal layer, and the first planarization layer is between the third metal layer and the fourth metal layer.

In some embodiments, the at least one switch transistor in the reset sub-circuit includes a reset switch transistor. A gate electrode of the reset switch transistor is coupled to the reset line, a first electrode of the reset switch transistor is coupled to the first power line, and a second electrode of the reset switch transistor serves as the first terminal of the reset sub-circuit.

In some embodiments, the pixel circuit further includes a first via hole penetrating through the second gate insulation layer and the interlayer dielectric layer and exposing a portion of the gate electrode of the driving transistor; and a second via hole in the second electrode plate of the storage capacitor and surrounding the first via hole, wherein no sidewall of the second via hole is in contact with a sidewall of the first via hole.

An active layer of the reset switch transistor is in the semiconductor layer, each of a first electrode and a second electrode of the reset switch transistor is in the third metal layer, and the second electrode of the reset switch transistor is coupled to the gate electrode of the driving transistor through the first via hole, so as to form the first node.

In some embodiments, the at least one switch transistor in the sensing sub-circuit includes a sensing switch transistor. A gate electrode of the sensing switch transistor is coupled to the sensing line, a first electrode of the sensing switch transistor serves as the first terminal of the sensing sub-circuit, and a second electrode of the sensing switch transistor is coupled to the reference line.

In some embodiments, the pixel circuit further includes a third via hole penetrating through the interlayer dielectric layer and exposing a portion of the second electrode plate of the storage capacitor.

Each of the first and second electrodes of the sensing switch transistor is in the third metal layer, and the first electrode of the sensing switch transistor is coupled to the second electrode plate of the storage capacitor through the third via hole, so as to form the second node.

In some embodiments, the pixel circuit further includes a transfer electrode in a fifth metal layer between the first planarization layer and the fourth metal layer; and a second planarization layer between the fifth metal layer and the fourth metal layer.

The first planarization layer is formed with a fourth via hole therein, the fourth via hole exposing a portion of the first electrode of the sensing switch transistor. The second planarization layer is formed with a fifth via hole therein, the fifth via hole exposing a portion of the transfer electrode. The first electrode of the light-emitting device is coupled to the transfer electrode through the fifth via hole, and the transfer electrode is coupled to the first electrode of the sensing switch transistor through the fourth via hole.

In some embodiments, an orthographic projection of the fourth via hole on a substrate does not overlap with an orthographic projection of the fifth via hole on the substrate.

In some embodiments, the at least one switch transistor in the threshold compensation sub-circuit includes a compensation switch transistor. A gate electrode of the compensation switch transistor is coupled to the scan line, a first electrode of the compensation switch transistor is coupled to the first electrode of the driving transistor, and a second electrode of the compensation switch transistor serves as the first terminal of the threshold compensation sub-circuit.

In some embodiments, the threshold compensation switch transistor is a double-gate transistor.

In some embodiments, the at least one switch transistor in the emission control sub-circuit includes a first control switch transistor and a second control switch transistor.

A gate electrode of the first control switch transistor is coupled to the light-emitting control line, a first electrode of the first control switch transistor is coupled to the first power line, and a second electrode of the first control switch transistor is coupled to the first electrode of the driving transistor.

A gate electrode of the second control switch transistor is coupled to the light-emitting control line, a first electrode of the second control switch transistor is coupled to the second electrode of the driving transistor, and a second electrode of the second control switch transistor serves as the first terminal of the light-emitting control sub-circuit.

In some embodiments, the at least one switch transistor in the data writing sub-circuit includes a writing switch transistor. A gate electrode of the writing switch transistor is coupled to the scan line, a first electrode of the writing switch transistor is coupled to the data line, and a second electrode of the writing switch transistor is coupled to the second electrode of the driving transistor.

In some embodiments, the second electrode plate of the storage capacitor and the fourth electrode plate of the voltage-stabilizing capacitor are in a same layer and made of a same material.

In some embodiments, the second electrode plate of the storage capacitor and the fourth electrode plate of the voltage-stabilizing capacitor are in the second metal layer.

In some embodiments, the sensing line and the scan line are in a same layer and made of a same material, and the reference line and the data line are in a same layer and made of a same material.

In some embodiments, the sensing line and the scan line are in the first metal layer, and the reference line and the data line are in the third metal layer.

In some embodiments, the driving transistor and all of the switch transistors are N-type transistors.

As a second aspect, a method for driving any of above pixel circuits is provided. The method includes: during the reset sub-period of the sensing period and the reset sub-period of the display period, providing, via the reset line, an active level signal such that the voltage signal on the first power line is transmitted to the first node through the reset sub-circuit; and providing, via the sensing line, an active level signal and providing, via the reference line, an initial voltage signal such that the initial voltage signal is transmitted to the second node through the sensing sub-circuit; during a data writing sub-period of the sensing period and a data writing sub-period of the display period, providing, via the scan line, an active level signal such that the data signal on the data line is transmitted to the second electrode of the driving transistor through the data writing sub-circuit, and the first electrode and the gate electrode of the driving transistor are electrically coupled through the threshold compensation sub-circuit; during a light-emitting sub-period of the sensing period, providing, via both of the sensing line and the light-emitting control line, an active level signal, such that the first power line and the first electrode of the driving transistor are electrically coupled through the light-emitting control sub-circuit, the second electrode of the driving transistor and the light-emitting device are electrically coupled through the light-emitting control sub-circuit, and a voltage at the second node is transmitted to the reference line through the sensing sub-circuit; and during a light-emitting sub-period of the display period, providing an active level signal via the light-emitting control line, such that the first power line and the first electrode of the driving transistor are electrically coupled through the light-emitting control sub-circuit, and the second electrode of the driving transistor and the light-emitting device are electrically coupled through the light-emitting control sub-circuit.

In some embodiments, during the display period, a voltage of the data signal on the data line is determined according to a target gray scale and a data voltage compensation value, and the data voltage compensation value is determined according to a voltage read out by the reference line during the light-emitting sub-period of the sensing period and a preset compensation model.

As a third aspect, a display device including above pixel circuit is provided.

BRIEF DESCRIPTION OF THE DRAWINGS

The accompanying drawings, which facilitate a further understanding of the present disclosure and constitute a part of the specification, are used in conjunction with the following specific embodiments to explain the present disclosure, but are not intended to limit the present disclosure. In the drawings.

DETAILED DESCRIPTION

In order to make the objects, technical solutions and advantages of the embodiments of the present disclosure more apparent, the technical solutions of the embodiments of the present disclosure will be clearly and completely described below with reference to the accompanying drawings of the embodiments of the present disclosure. It is to be understood that the described embodiments are only a part but not all of embodiments of the present disclosure.

All other embodiments, which can be derived by the skilled in the art from the described embodiments of the present disclosure without inventive step, fall within the scope of the present disclosure.

Technical or scientific terms used herein shall have the ordinary meaning as understood by one of ordinary skill in the art to which the present disclosure belongs unless defined otherwise. The use of "first," "second," and similar terms in the present disclosure is not intended to indicate any order, quantity, or importance, but rather is used to distinguish one element from another. Similarly, the word "include" or "comprise", and the like, means that the element or item preceding the word includes the element or item listed after the word and its equivalent, but does not exclude other elements or items. The terms "connect" or "couple" and the like are not limited to physical or mechanical connections, but may include electrical connections, whether direct or indirect.

The transistors in all embodiments of the present disclosure may be thin film transistors or field effect transistors or other devices of the same characteristics. Since source and drain electrodes of the transistor are symmetrical, there is no difference between the source and drain electrodes. In order to distinguish the source and drain electrodes of the transistor, one of the electrodes is called a first electrode and the other electrode is called a second electrode.

Figure 1:
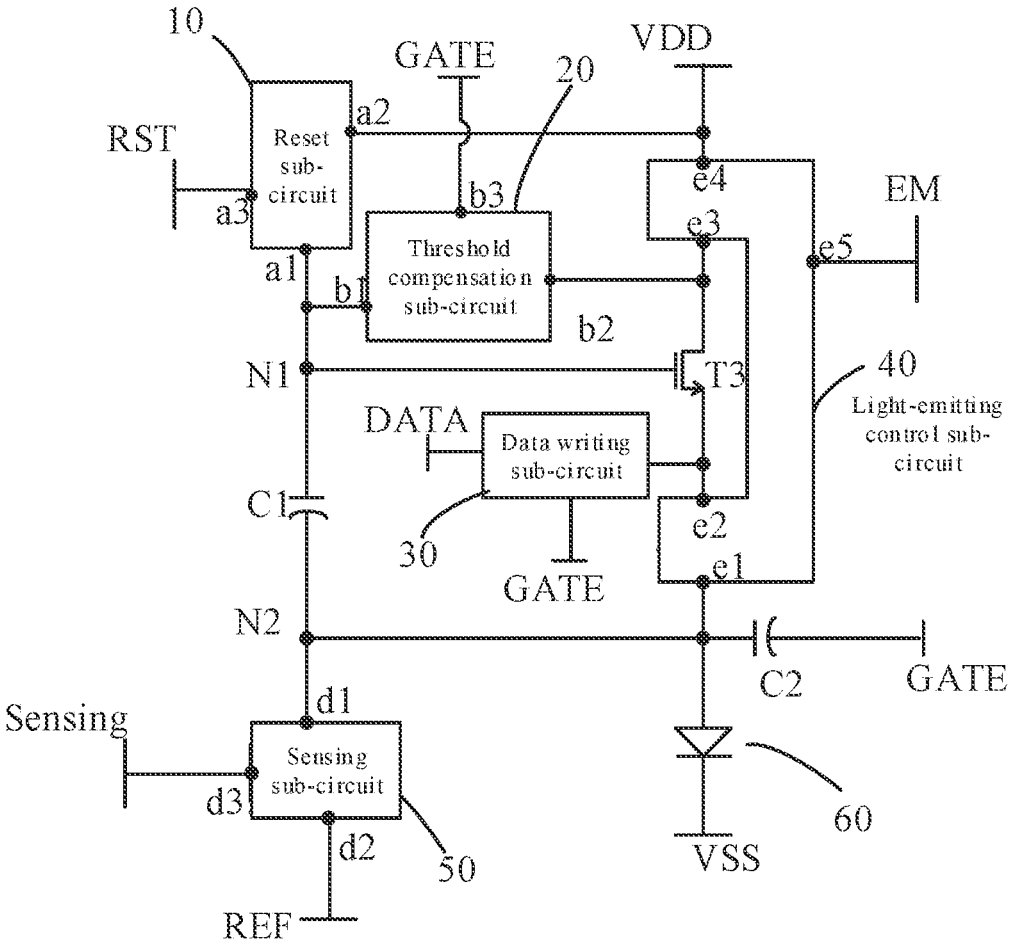
FIG. 1 is a functional block diagram showing a pixel circuit provided by some embodiments of the present disclosure.

As a first aspect, an embodiment of the present disclosure provides a pixel circuit. FIG. 1 is a schematic block diagram showing a pixel circuit provided by some embodiments of the present disclosure. As shown in FIG. 1, the pixel circuit includes: a driving transistor T3, a storage capacitor C1, a voltage-stabilizing capacitor C2, a data writing sub-circuit 30, a threshold compensation sub-circuit 20, a reset sub-circuit 10, a sensing sub-circuit 50, and a light-emitting control sub-circuit 40.

A first terminal of the storage capacitor C1, a gate electrode of the driving transistor T3, a first terminal a1 of the reset sub-circuit 10, and a first terminal b1 of the threshold compensation sub-circuit 20 are coupled to a first node (i.e., node N1). A second terminal of the storage capacitor C1, a first terminal d1 of the sensing sub-circuit 50, and a first electrode of a light-emitting device 60 are coupled to a second node (i.e., node N2). The Light-emitting device 60 in the embodiment of the present disclosure may be a current-driven light-emitting device 60 such as a Light-Emitting Diode (LED) or an Organic Light-Emitting Diode (OLED), and the embodiment of the present disclosure is illustrated by taking the OLED as an example. Optionally, the first electrode of the light-emitting device 60 is an anode and a second electrode of the light-emitting device 60 is a cathode. The second electrode of the light-emitting device 60 is coupled to a second power line VSS for supplying a low-level signal. The first terminal and the second terminal of the storage capacitor C1 are two electrode plates of the storage capacitor C1, respectively.

A second terminal a2 of the reset sub-circuit 10 is coupled to a first power line VDD, and a control terminal a3 of the reset sub-circuit 10 is coupled to a reset line RST. The reset sub-circuit 10 is configured to transmit a voltage signal on the first power line VDD to the node N1 in response to the control of the reset line RST. The first power line VDD is a signal line that provides a high-level signal Vdd.

A control terminal d3 of the sensing sub-circuit 50 is coupled to the sensing line Sensing, and a second terminal d2 of the sensing sub-circuit 50 is coupled to a reference line REF. The sensing sub-circuit 50 is configured to transmit an initial voltage signal on the reference line REF to the node N2 in response to the control of the sensing line Sensing during a reset sub-period of a sensing period and a reset sub-period of a display period, so as to reset the node N2; and to transmit a voltage at the node N2 to the reference line REF in response to the control of the sensing line Sensing during a light-emitting sub-period of the sensing period, so as to read the voltage at the node N2.

A control terminal b3 of the threshold compensation sub-circuit 20 is coupled to a scan line GATE, and a second terminal b2 of the threshold compensation sub-circuit 20 is coupled to a first electrode of the driving transistor T3. The threshold compensation sub-circuit 20 is configured to electrically couple the first electrode and the gate electrode of the driving transistor T3 in response to the control of the scan line GATE, so as to write a threshold voltage of the driving transistor T3 into the storage capacitor C1.

The data writing sub-circuit 30 is coupled to the scan line GATE, the data line DATA, and a second electrode of the driving transistor T3. The data writing sub-circuit 30 is configured to transmit a voltage signal on a data line DATA to the second electrode of the driving transistor T3 in response to the control of the scan line GATE.

A control terminal e5 of the light-emitting control sub-circuit 40 is coupled to a light-emitting control line EM, a first terminal e1 of the light-emitting control sub-circuit 40 is coupled to the first electrode of the light-emitting device 60, a second terminal e2 of the light-emitting control sub-circuit 40 is coupled to the second electrode of the driving transistor T3, a third terminal e3 of the light-emitting control sub-circuit 40 is coupled to the first electrode of the driving transistor T3, and a fourth terminal e4 of the light-emitting control sub-circuit 40 is coupled to the first power line VDD. The light-emitting control sub-circuit 40 is configured to electrically couple the first electrode of the driving transistor T3 and the first power line VDD and to electrically couple the second electrode of the driving transistor T3 and the light-emitting device 60 in response to the control of the light-emitting control line EM.

A first terminal of the voltage-stabilizing capacitor C2 is coupled to the node N2, and a second terminal of the voltage-stabilizing capacitor C2 is coupled to the scan line GATE.

In the embodiment of the present disclosure, the threshold compensation sub-circuit 20 electrically couples the gate electrode and the first electrode of the driving transistor T3 under the control of the scan line GATE, thereby writing the threshold voltage of the driving transistor T3 into the storage capacitor C1. Therefore, when the light-emitting device 60 emits light, a driving current supplied to the light-emitting device 60 by the driving transistor T3 is not related to the threshold voltage, thereby improving the display uniformity of the display device.

Specifically, the operation process of the pixel circuit in the embodiment of the present disclosure may include: a sensing period and a display period. Each of the sensing period and the display period includes a reset sub-period, a data writing sub-period and a light-emitting sub-period. During the reset sub-period of the display period, an active level signal may be provided to the reset line RST and an active level signal may be provided to the sensing line Sensing, so that the voltage signal on the first power line VDD is transmitted to the node N1 through the reset sub-circuit 10, and the initial voltage signal on the reference line REF is transmitted to the node N2 through the sensing sub-circuit 50. The voltage at the node N1 reaches Vdd, and the voltage at the node N2 reaches the initial voltage Vinit. During the data writing sub-period of the display period, an active level signal may be provided to the scan line GATE, so that the data signal on the data line DATA is transmitted to the second electrode of the driving transistor T3 through the data writing sub-circuit 30, and the threshold compensation sub-circuit 20 shorts the gate electrode and the first electrode of the driving transistor T3 to form a diode structure. In this case, the voltage at the node N1 reaches Vdata+Vth, where Vdata is the voltage of the data signal on the data line DATA. During the light-emitting sub-period of the display period, under the voltage holding effect of the storage capacitor C1, the voltage at the node N1 is kept as Vdata+Vth. The voltage of the first power line VDD generates a driving current flowing into the light-emitting device 60 via the light-emitting control module 40 and the driving transistor T3. At this time, the driving current Ioled satisfies the following saturation current formula.

$$Ioled=K(Vgs-Vth)^2=K(V\text{data}+Vth-Vdd-Vth)^2=K(V\text{data}-Vdd)^2 \quad (1)$$

where K is a coefficient relating to the structural characteristics of the driving transistor T3 itself and can be regarded as a constant. Vgs is a gate-source voltage of the driving transistor T3. It can be seen that the driving current supplied to the light-emitting device 60 is not affected by the threshold voltage of the driving transistor T3.

The active level signal is a signal that can control the transistors in the pixel circuit to turn on. In the embodiment of the present disclosure, each of the transistors is an N-type transistor, and in this case, the active level signal is a high-level signal.

In addition, two terminals of the voltage-stabilizing capacitor C2 are respectively coupled to the node N2 and the scan line GATE. A high-level signal is provided via the scan line GATE during the data writing sub-period, so that the voltage at the node N2 reaches a certain high-level voltage during the data writing sub-period, and thus at the instant when a high-level signal is provided via the light-emitting control line EM, the voltage at the node N2 cannot jump significantly, thereby improving the light-emitting effect of the light-emitting device 60.

The operation of the pixel circuit during the sensing period is similar to that in the display period, but the operation of the pixel circuit during the sensing period differs from that in the display period in that during the light-emitting sub-period of the sensing period, the voltage signal at the node N2 is transmitted to the reference line REF through the sensing sub-circuit 50 under the control of the sensing line Sensing, so as to read the voltage at the node N2.

The display period is a period during which the display device where the pixel circuit is located normally displays an image, and the sensing period is a period between a timing when the display device receives a power-on signal and a timing when the display device normally displays the image. It can be understood that the driving transistor T3 may be aged as the use time of the display device increases, and the degree of aging may be different for various driving transistors T3. Therefore, even in the case of the same driving current, the emission luminance for various light-emitting devices 60 may be different from each other. By reading the voltage at the node N2 during the sensing period, a compensation value of the data signal can be determined according to the voltage at the node N2, and the data signal provided to the data line DATA can be compensated according to the compensation value during the subsequent display period, so that the emission luminance of various light-emitting devices 60 under the same driving current are the same with each other.

In the embodiment of the present disclosure, the sensing sub-circuit 50 may reset the node N2 and read out the voltage at the node N2, thereby simplifying the structure of the pixel circuit.

In the embodiment of the present disclosure, each of the data writing sub-circuit 30, the reset sub-circuit 10, the threshold compensation sub-circuit 20, the light-emitting control sub-circuit 40, and the sensing sub-circuit 50 includes at least one switch transistor. The driving transistor T3, the storage capacitor C1, the voltage-stabilizing capacitor C2, and the switch transistors in the sub-circuits are respectively disposed in a semiconductor layer, a first metal layer, a second metal layer, and a third metal layer that are stacked in sequence, and spaced apart and insulated from each other. All of the semiconductor layer, the first metal layer, the second metal layer and the third metal layer are formed on a substrate and sequentially arranged along a direction far away from the substrate. The first electrode of the light-emitting device 60 is disposed in a fourth metal layer which is located on a side of the third metal layer away from the second metal layer.

It should be noted that "stacked in sequence" in the embodiment of the present disclosure means that the semiconductor layer, the first metal layer, the second metal layer, and the third metal layer are stacked along a direction away from the substrate, but does not mean that these film layers are necessarily attached to each other one by one.

In the embodiment of the present disclosure, the storage capacitor C1 includes a first electrode plate and a second electrode plate disposed opposite to each other, and at least a portion of the first electrode plate serves as a portion of the gate electrode of the driving transistor T3. That is to say, an orthographic projection of the second electrode plate on the substrate overlaps an orthographic projection of the gate electrode of the driving transistor T3 on the substrate, and an overlap region where the orthographic projection of the second electrode plate on the substrate overlaps the orthographic projection of the gate electrode of the driving transistor T3 on the substrate is the region where the storage capacitor C1 is located.

A portion of the gate electrode of the driving transistor T3 serves as at least a portion of the first electrode plate, so that the gate electrode of the driving transistor T3 and the first electrode plate of the storage capacitor C1 can be manufactured and formed simultaneously, thereby simplifying the manufacture process and reducing the manufacture cost, and further, decreasing a total area occupied by the storage capacitor C1 and the driving transistor T3 in the pixel region, which is advantageous for reducing the area of the pixel region and achieving a high resolution of the display product.

The voltage-stabilizing capacitor C2 includes a third electrode plate and a fourth electrode plate disposed opposite to each other, and at least a portion of the third electrode plate is in the same layer as the scan line GATE. The fourth electrode plate may be directly facing to a portion of the scan line GATE, and in this case an overlap region where an orthographic projection of the fourth electrode plate on the substrate overlaps an orthographic projection of the scan line GATE on the substrate is a region where the voltage-stabilizing capacitor C2 is located.

At least a portion of the third electrode plate is in the same layer as the scan line GATE, therefore the third electrode plate and the scan line can be manufactured and formed simultaneously, thereby simplifying the manufacture process and reducing the manufacture cost, and further, decreasing a total area occupied by the scan line GATE and the voltage-stabilizing capacitor C2 in a pixel region, and realizing a high resolution of the display product.

In some embodiments, the second electrode plate of the storage capacitor C1 and the fourth electrode plate of the voltage-stabilizing capacitor C2 are disposed in the same layer and made of the same material, therefore the second electrode plate of the storage capacitor C1 and the fourth electrode plate of the voltage-stabilizing capacitor C2 can be formed by the same manufacture process, thereby simplifying the manufacture process and reducing the manufacture cost.

Figure 2:
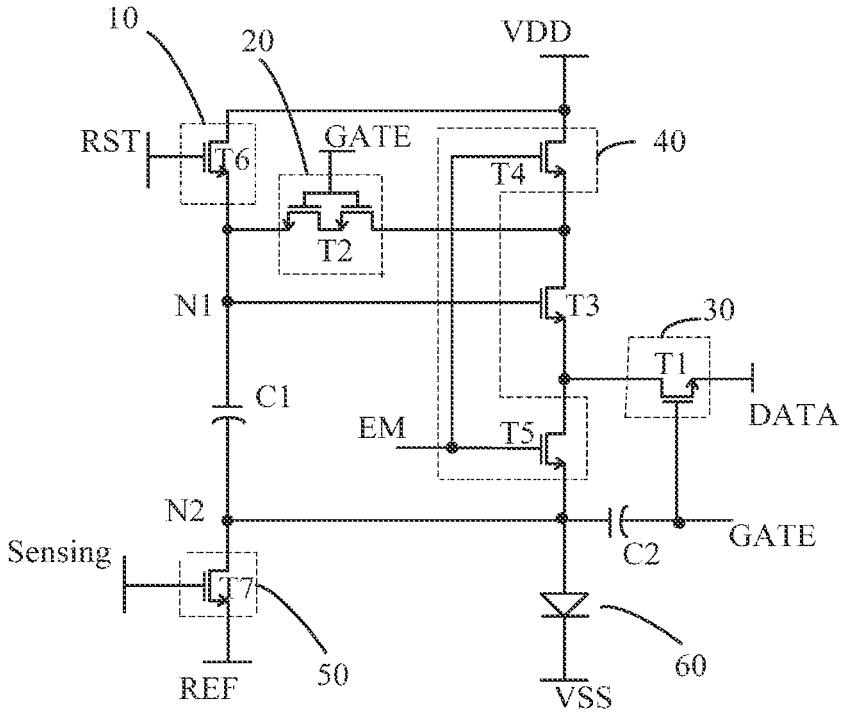
FIG. 2 is a specific circuit diagram showing a pixel circuit provided by some embodiments of the present disclosure.

FIG. 2 is a specific circuit schematic diagram showing a pixel circuit provided by some embodiments of the present disclosure. As shown in FIG. 1 and FIG. 2, the switch transistor in the reset sub-circuit 10 includes a reset switch transistor T6. A gate electrode of the reset switch transistor T6 serves as the control terminal a3 of the reset sub-circuit 10 and is coupled to the reset line RST, a first electrode of the reset switch transistor T6 serves as the second terminal of the reset sub-circuit 10 and is coupled to the first power line VDD, and a second electrode of the reset switch transistor T6 serves as the first terminal of the reset sub-circuit 10 and is coupled to the node N1. In some embodiments, the reset switch transistor T6 is a double-gate transistor.

The switch transistor in the data writing sub-circuit 30 includes a writing switch transistor T1. A gate electrode of the writing switch transistor T1 is coupled to the scan line GATE, a first electrode of the writing switch transistor T1 is coupled to the data line DATA, and a second electrode of the writing switch transistor T1 is coupled to the second electrode of the driving transistor T3.

The switch transistor in the sensing sub-circuit 50 includes a sensing switch transistor T7. A gate electrode of the sensing switch transistor T7 serves as the control terminal d3 of the sensing sub-circuit 50 and is coupled to the sensing line Sensing, a first electrode of the sensing switch transistor T7 serves as the first terminal d1 of the sensing sub-circuit 50 and is coupled to the node N2, and a second electrode of the sensing switch transistor T7 serves as the second terminal d2 of the sensing sub-circuit 50 and is coupled to the reference line REF.

The threshold compensation sub-circuit 20 includes a compensation switch transistor T2. A gate electrode of the compensation switch transistor T2 serves as the control terminal b3 of the threshold compensation sub-circuit 20 and is coupled to the scan line GATE, a first electrode of the compensation switch transistor T2 serves as the second terminal of the threshold compensation sub-circuit 20 and is coupled to the first electrode of the driving transistor T3, and a second electrode of the compensation switch transistor T2 serves as the first terminal of the threshold compensation sub-circuit 20 and is coupled to the node N1. In some embodiments, the compensation switch transistor T2 is a double-gate transistor, so that the leakage current can be decreased, and the gate voltage of the driving transistor T3 can be more stable during the light-emitting period.

The light-emitting control sub-circuit 40 includes a first control switch transistor T4 and a second control switch transistor T5. A gate electrode of the first control switch transistor T4 is coupled to a gate electrode of the second control switch transistor T5 and serves as the control terminal e5, being coupled to the light-emitting control line EM, of the light-emitting control sub-circuit 40. A first electrode of the first control switch transistor T4 serves as the fourth terminal e4 of the light-emitting control sub-circuit 40 and is coupled to the first power line VDD. A second electrode of the first control switch transistor T4 serves as the third terminal e3 of the light-emitting control sub-circuit 40 and is coupled to the first electrode of the driving transistor T3. A first electrode of the second control switch transistor T5 serves as the second terminal e2 of the light-emitting control sub-circuit 40 and is coupled to the second electrode of the driving transistor T3. A second electrode of the second control switch transistor T5 serves as the first terminal e1 of the light-emitting control sub-circuit 40 and is coupled to the node N2.

In the embodiment of the present disclosure, all of the transistors in the pixel circuit are N-type transistors, therefore the transistors can be manufactured by the same manufacture process at the same time, thereby shortening the production cycle of the pixel circuit. It should be noted that all of the transistors T1 to T7 in the pixel circuit are N-type transistors, which is only an exemplary implementation of the present disclosure. It is to be understood that each of the transistors in the pixel circuit may also be a P-type transistor; alternatively, some of the transistors are N-type transistors and the other of the transistors are P-type transistors, which can be easily conceived by those skilled in the art without inventive work and fall within the scope of the embodiments of the present disclosure.

The operation of the pixel circuit provided by the embodiments of the present disclosure will be described in detail below with reference to the accompanying drawings. In the following description, each of the transistors T1-T7 is an N-type transistor, for example.

Figure 3:
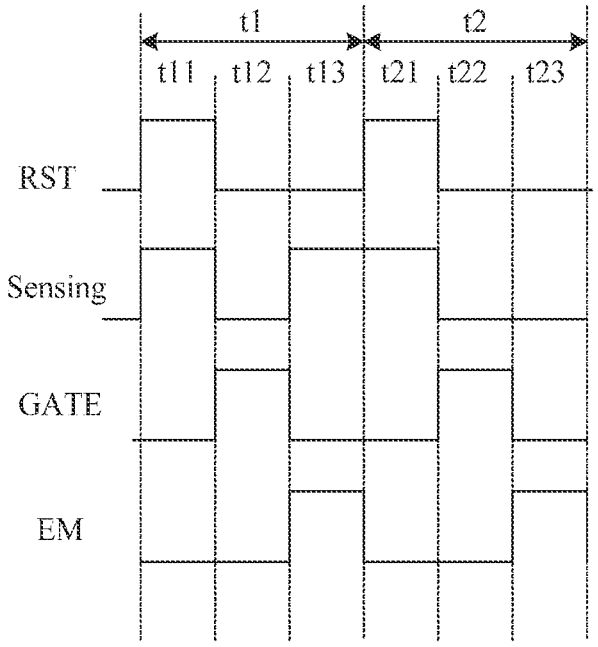
FIG. 3 is a timing diagram showing an operation of the pixel circuit shown in FIG. 2.

FIG. 3 is a timing diagram showing an operation of the pixel circuit shown in FIG. 2. As shown in the figure, the operation of the pixel circuit includes a sensing period t1 and a displaying period t2. The sensing period includes: a reset sub-period t11, a data writing sub-period t12 and a light-emitting sub-period 13. The display period includes a reset sub-period t21, a data writing sub-period t22, and a light-emitting sub-period t23. The display period t2 is a period when a target image is normally displayed, and the sensing period t1 is a period between a timing when the power-on signal is received by the display device and the display period t2. During the sensing period t1, voltages of data signals received by the pixel circuits may be the same with each other, such that a voltage value at the node N2 of each of the pixel circuits under the same driving current is detected, a compensation value of the data voltage is further determined according to the voltage at the node N2, and the data voltage during the display period is compensated by using the compensation value. For each of the pixel circuits in the display device, after the display device receives the power-on signal, the pixel circuit undergoes the sensing period t1 once; and the pixel circuit undergoes a display period t2 every time the display device displays a target image.

During the reset sub-period t11 of the sensing period t1, a high-level signal is provided via both of the reset line RST and the sensing line Sensing, an initial voltage signal is provided via the reference line REF, and a low-level signal is provided via the scan line GATE and the light-emitting control line EM. In this case, the reset switch transistor T6 and the sensing switch transistor T7 are turned on, and the first control switch transistor T4, the second control switch transistor T5, the writing switch transistor T1, and the compensation switch transistor T2 are all turned off. Since the reset switch transistor T6 is turned on, the voltage signal on the first power line VDD is transmitted to the node N1 through the reset switch transistor T6, and the voltage at the node N1 is Vdd at this time; meanwhile, the initial voltage signal on the reference line REF is transmitted to the node N2 through the sensing switch transistor T7, and the voltage at the node N2 reaches Vinit at this time.

During the data writing sub-period t12 of the sensing period t1, a low-level signal is provided via each of the reset line RST, the sensing line Sensing and the light-emitting control line EM, and a high-level signal is provided via the scan line GATE. In this case, the reset switch transistor T6, the sensing switch transistor T7, the first control switch transistor T4, and the second control switch transistor T5 are all turned off, and the writing switch transistor T1 and the compensation switch transistor T2 are all turned on.

In this case, since the writing switch transistor T1 is turned on, the data voltage signal on the data line DATA is transmitted to the second electrode of the driving transistor T3 through the writing switch transistor T1, so that the second electrode of the driving transistor T3 has a voltage of Vdata. Meanwhile, since the voltage at the node N1 is Vdd, the driving transistor T3 is turned on. Moreover, since the compensation switch transistor T2 is turned on, the data line DATA establishes an electrical path to the node N1 via the writing switch transistor T1, the driving transistor T3, and the compensation switch transistor T2. The data line DATA starts to charge the node N1 until the voltage at the node N1 becomes Vdata+Vth, where Vth is the threshold voltage of the driving transistor T3.

It should be noted that although the driving transistor T3 is turned on and a driving current is generated during the data writing sub-period t12, no driving current flows into the display device 60, because the second control switch transistor T5 is turned off, and therefore, the light-emitting device 60 does not emit light.

During the light-emitting sub-period t13 of the sensing period t1, a low-level signal is supplied via each of the reset line RST and the scan line GATE, and a high-level signal is supplied via each of the light-emitting control line EM and the sensing line Sensing. In this case, the reset switch transistor T6, the compensation switch transistor T2, and the writing switch transistor T1 are all turned off, and the driving transistor T3 and the sensing switch transistor T7 are turned on. With the voltage holding effect of the storage capacitor C1, the voltage at the node N1 is held at Vdata+Vth, such that the driving transistor T3 is kept on, and a driving current flows into the light-emitting device 60, and the light-emitting device 60 emits light. A magnitude of the driving current is shown in above formula (1).

It should be noted that, during the light-emitting sub-period t13 of the sensing period t1, an external driving chip no longer provides a high-level or a low-level signal to the reference line REF, but reads the voltage at the node N2 through the reference line REF.

During the reset sub-period t21 of the display period t2, a high-level signal is provided via each of the reset line RST and the sensing line Sensing, an initial voltage signal is provided via the reference line REF, and a high-level signal is provided via the light-emitting control line EM. In this case, the on state of each of the transistors is the same as that in the reset sub-period t11 of the sensing period t1. The voltage at the node N1 is Vdd, and the voltage at the node N2 reaches Vinit.

During the data writing sub-period t22 of the display period t2, each of the reset line RST, the sensing line Sensing and the light-emitting control line EM supplies a low-level signal, and the scan line GATE supplies a high-level signal. At this time, the on state of each of the transistors is the same as that in the data writing sub-period t12 of the sensing period t1, and the voltage of the node N1 reaches Vdata+Vth.

During the light-emitting sub-period t23 of the display period t2, a low-level signal is provided via each of the reset line RST, the scan line GATE and the sensing line Sensing, and a high-level signal is provided via the light-emitting control line EM. The light-emitting sub-period t23 of the sensing period t2 is the same as the light-emitting sub-period t13 of the display period t1 in that each of the reset switch transistor T6, the compensation switch transistor T2, and the writing switch transistor T1 is turned off, and the driving transistor T3 is turned on. With the voltage holding effect of the storage capacitor C1, the voltage at the node N1 is kept as Vdata+Vth, and the driving transistor T3 is turned on, so that a driving current flows into the light-emitting device 60 and thus the light-emitting device 60 emits light. The magnitude of the driving current is shown in above formula (1). The light-emitting sub-period t23 of the display period t2 is different from the light-emitting sub-period t13 of the sensing period t1 in that the sensing switch transistor T7 is turned off because a low-level signal is provided via the sensing line Sensing.

In the display device, the pixel circuits in the same column are coupled to the same reference line REF, and the pixel circuits in the same row are coupled to the same sensing line. During the sensing period, a sensing signal is provided to the sensing lines Sensing of the pixel circuits row by row, so that the voltages at the nodes N2 of the plurality of pixel circuits in one row are read out via the reference line REF. In order to couple the reference line REF to the pixel circuits in a corresponding column and couple the sensing line Sensing to the pixel circuits in a corresponding row, in the embodiment of the present disclosure, the reference lines REF and the data lines DATA may be arranged in parallel to each other and extending along a column direction of the arranged pixels; the sensing lines Sensing and the scan lines GATE may be arranged in parallel to each other and extending along a row direction of the arranged pixels. In order to simplify the manufacture process, in some embodiments, the sensing lines Sensing and the scan lines Gate are disposed in the same layer and made of the same material, and the reference lines REF and the data lines DATA are disposed in the same layer and made of the same material, therefore the sensing lines Sensing and the scan lines Gate can be formed simultaneously, and the reference lines REF and the data lines DATA can be formed simultaneously.

In the embodiment of the present disclosure, the transistors T1-T7, the storage capacitor C1, the voltage-stabilizing capacitor C2, the scan line GATE, the reset line RST, the light-emitting control line EM, the sensing line Sensing, the first power line VDD, the reference line REF, and the data line DATA are respectively disposed in a semiconductor layer, a first metal layer, a second metal layer, and a third metal layer on the substrate. The first electrode of the light-emitting device is disposed in the fourth metal layer. In addition, the pixel circuit further includes a transfer electrode disposed in a fifth metal layer, the fifth metal layer being between the third metal layer and the fourth metal layer.

Figure 4:
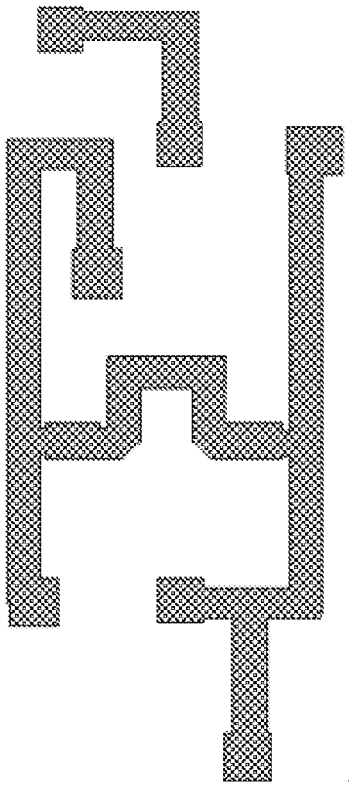
FIG. 4 is a schematic diagram showing a semiconductor layer provided by some embodiments of the present disclosure.

FIG. 4 is a schematic diagram showing a semiconductor layer provided by some embodiments of the present disclosure. The semiconductor layer may be made of a material such as polysilicon or metal oxide, which is not limited in the embodiment of the present disclosure. Active layers of the transistors T1 to T7 are disposed in the semiconductor layer. In addition, the first electrode of the compensation switch transistor T2, the second electrode of the writing switch transistor T1, the first and second electrodes of the driving transistor T3, the first electrode of the second control switch transistor T5, and the second electrode of the first control switch transistor T4 are all disposed in the semiconductor layer. It is to be understood that when a first electrode or a second electrode of a transistor is disposed in a semiconductor layer, the respective first electrode or second electrode can be formed by performing a conductorization process on a respective position of the semiconductor layer.

Figure 5:
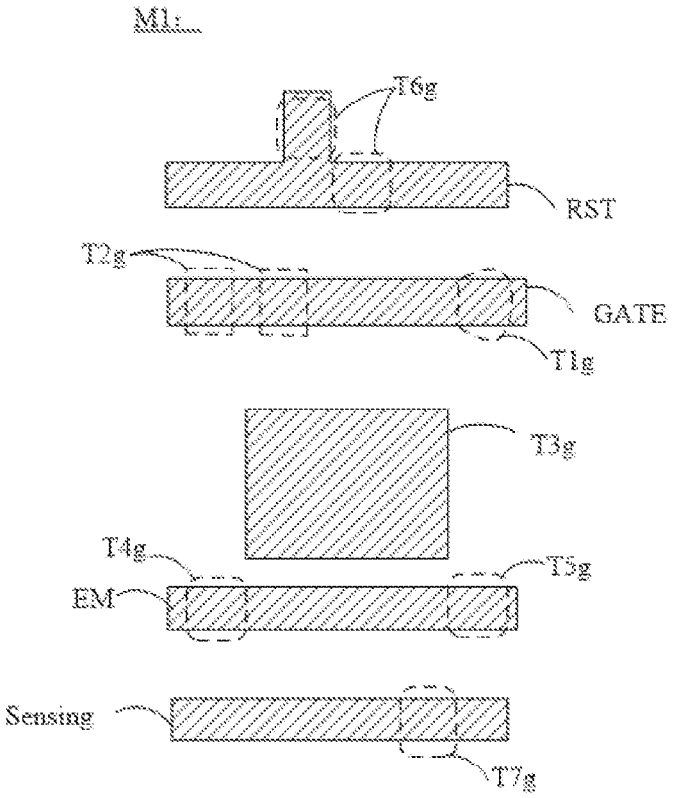
FIG. 5 is a schematic diagram showing a first metal layer provided by some embodiments of the present disclosure.

FIG. 5 is a schematic diagram showing a first metal layer provided by some embodiments of the present disclosure. Optionally, the first metal layer M1 may be made of a metal material such as silver, aluminum, molybdenum, or copper, which is not specifically limited in the present disclosure. The gate electrodes of the transistors T1 to T7, the scan line GATE, the reset line RST, the light-emitting control line EM are disposed in the first metal layer M1. The gate electrode T6*g* of the reset switch transistor T6 and the reset line RST are formed as one-piece structure. Each of the gate electrode T1*g* of the writing switch transistor T1 and the gate electrode T2*g* of the compensation switch transistor T2 is a portion of the scan line GATE. Each of the gate electrode T4*g* of the first control switch transistor T4 and the gate electrode T5*g* of the second control switch transistor T5 is a portion of the light-emitting control line EM. The gate electrode T7*g* of the sensing switch transistor T7 is a portion of the sensing line Sensing. The reset line RST, the scan line GATE, the light-emitting control line EM, and the sensing line Sensing are substantially parallel to each other. The scan line GATE and the light-emitting control line EM are located between the scan line GATE and the sensing line Sensing, and the gate electrode T3*g* of the driving transistor T3 is located between the scan line GATE and the light-emitting control line EM.

Figure 6:
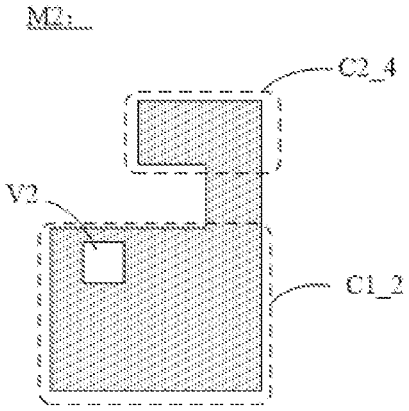
FIG. 6 is a schematic diagram showing a second metal layer provided by some embodiments of the present disclosure.

FIG. 6 is a schematic diagram showing a second metal layer provided by some embodiments of the present disclosure. Optionally, the second metal layer M2 may be made of a metal material such as silver, aluminum, molybdenum, or copper, which is not limited in the embodiment of the present disclosure. Each of the second electrode plate C1_2 of the storage capacitor C1 and the fourth electrode plate C2_4 of the voltage-stabilizing capacitor C2 is disposed in the second metal layer M2. The second electrode plate C1_2 and the fourth electrode plate C2_4 are connected and formed as one-piece structure. The second electrode plate C1_2 is formed with a second via hole V2 therein through which the second electrode of the reset switch transistor T6 is coupled to the gate electrode of the driving transistor T3.

Figure 7:
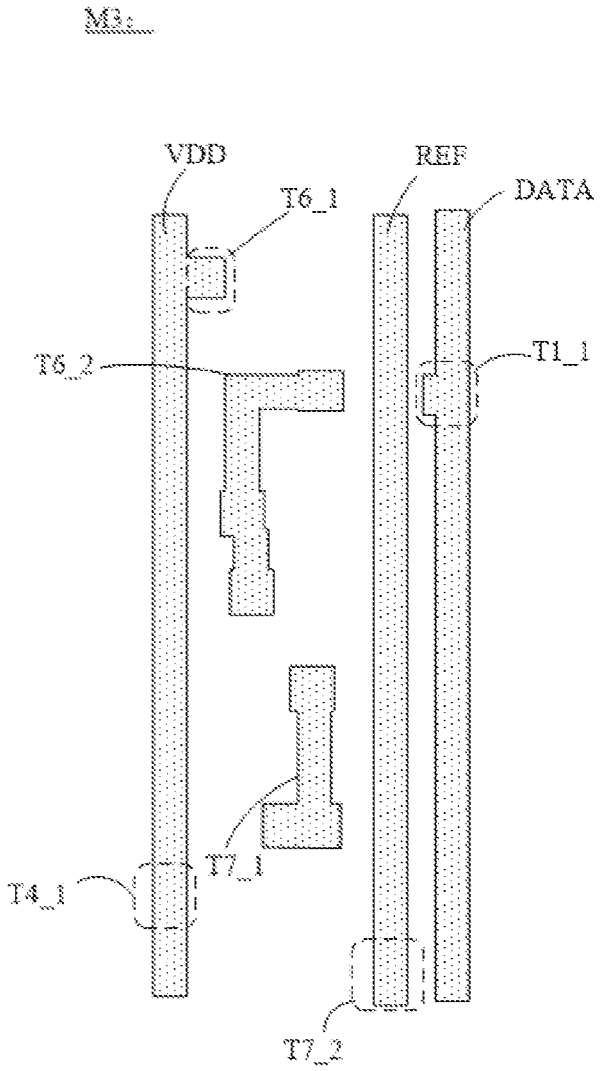
FIG. 7 is a schematic diagram showing a third metal layer provided by some embodiments of the present disclosure.

FIG. 7 is a schematic diagram showing a third metal layer provided by some embodiments of the present disclosure. Optionally, the third metal layer M3 may be made of a metal material such as silver, aluminum, molybdenum, or copper, which is not limited in the embodiment of the present disclosure. As shown in FIG. 7, the data line DATA, the first power line VDD, and the reference line REF are disposed in the third metal layer M3. The reference line REF is between the data line DATA and the first power line VDD. The first electrode T1_1 of the writing switch transistor T1 is formed as an integral structure with the data line DATA, and the first electrode T6_1 of the reset switch transistor T6 and the first power line VDD are connected and formed as an integral structure or one-piece structure. The second electrode T6_2 of the reset switch transistor T6 is disposed in the third metal layer M3 and is formed as an integral structure or one-piece structure with the second electrode of the compensation switch transistor T2. The first electrode T4_1 of the first control switch transistor T4 is a portion of the first power line VDD, and the second electrode of the second control switch transistor T5 and the first electrode T7_1 of the sensing switch transistor T7 are formed as an integrated structure or one-piece structure and disposed in the third metal layer M3.

Figure 8:
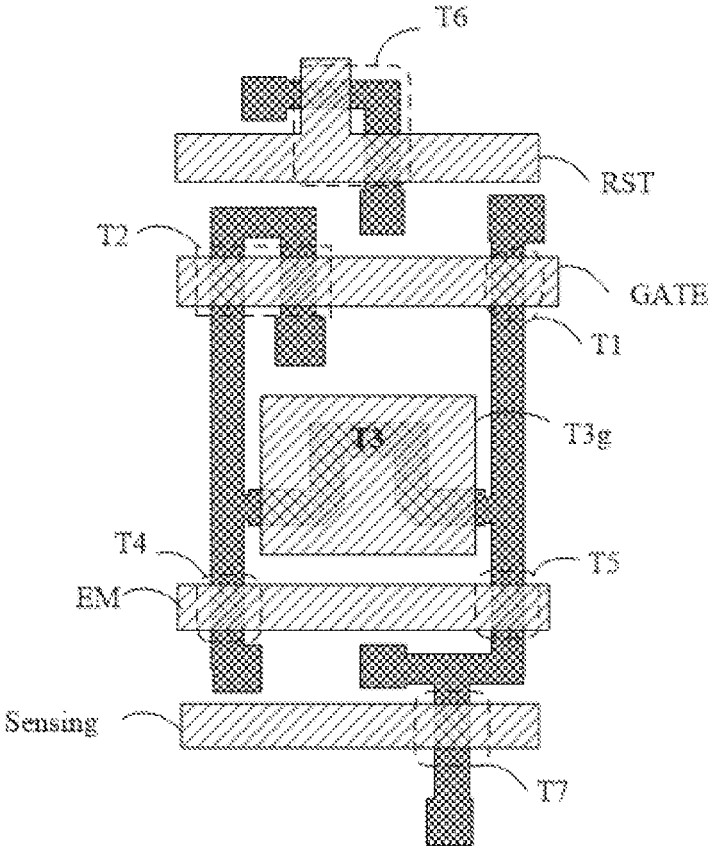
FIG. 8 is a schematic diagram showing a semiconductor layer stacked with a first metal layer provided by some embodiments of the present disclosure.
Figure 9:
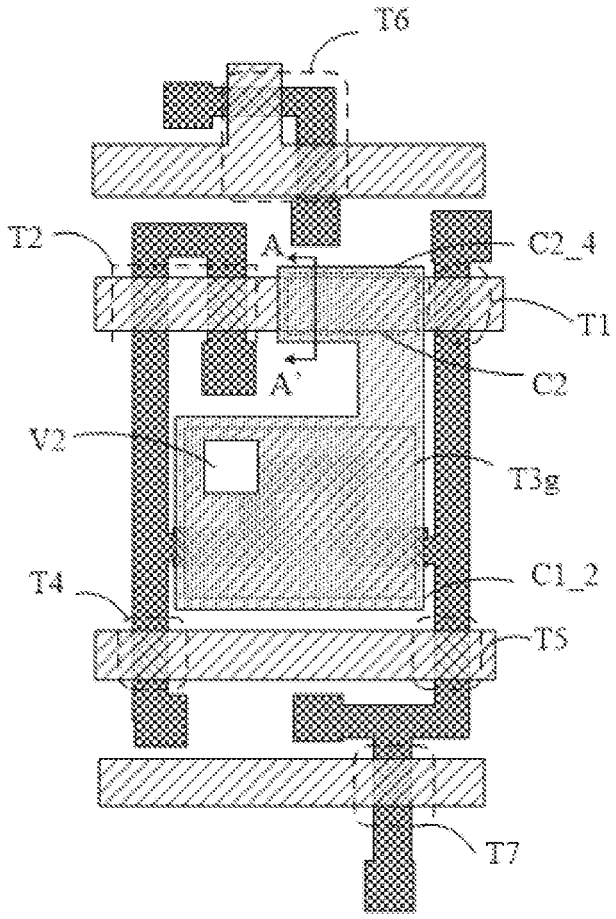
FIG. 9 is a schematic diagram showing a semiconductor layer, a first metal layer, and a second metal layer stacked with each other provided by some embodiments of the present disclosure.
Figure 10:
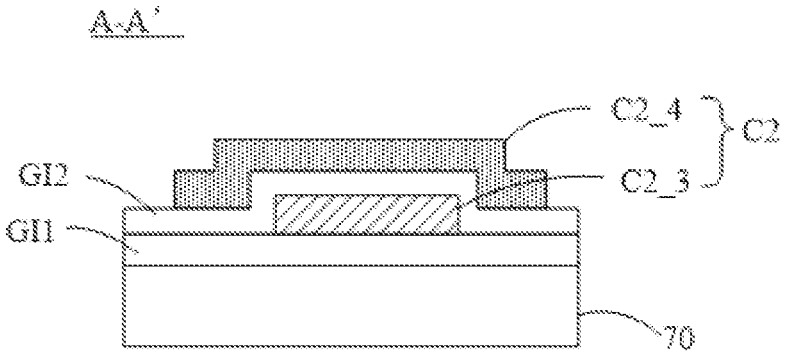
FIG. 10 is a sectional view taken along line A-A' of FIG. 9.
Figure 11:
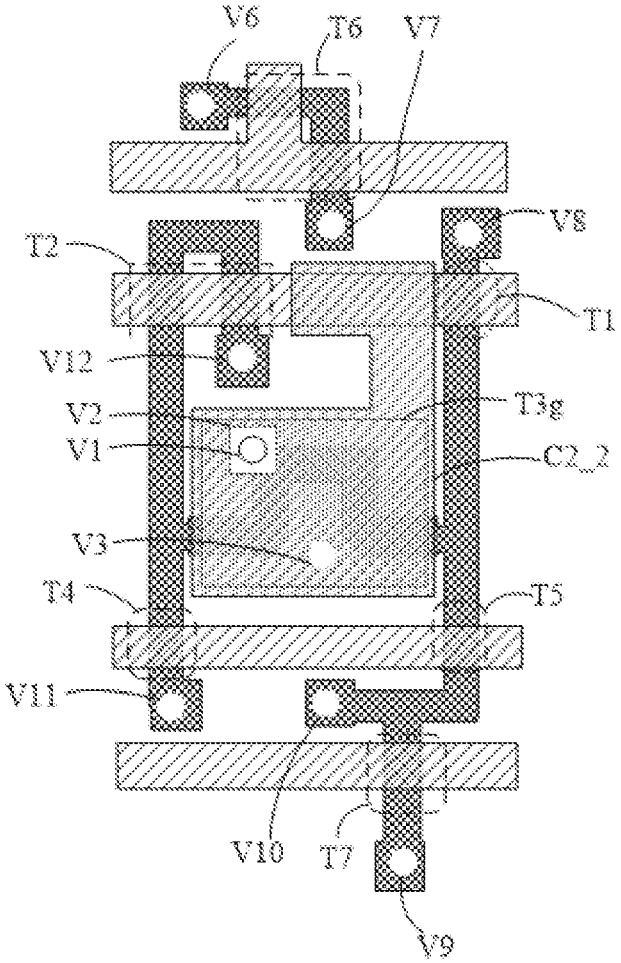
FIG. 11 is a schematic diagram showing locations of via holes of an interlayer dielectric layer provided by some embodiments of the present disclosure.
Figure 12:
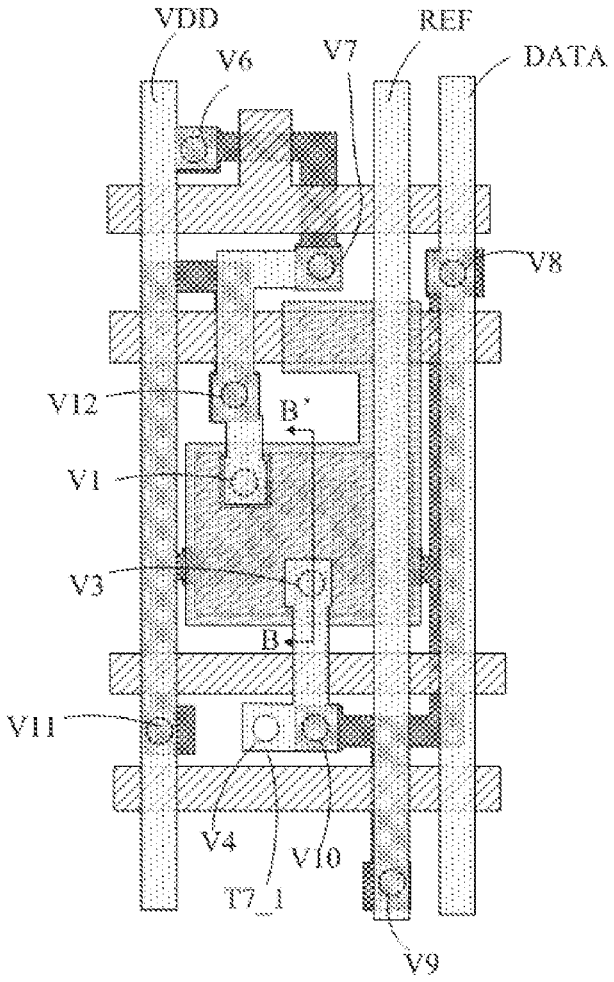
FIG. 12 is a schematic diagram showing a semiconductor layer, a first metal layer, a second metal layer and a third metal layer stacked with each other provided by some embodiments of the present disclosure.

FIG. 8 is a schematic diagram showing a semiconductor layer stacked with a first metal layer provided by some embodiments of the present disclosure. FIG. 9 is a schematic diagram showing a semiconductor layer, a first metal layer and a second metal layer stacked with each other provided by some embodiments of the present disclosure. FIG. 10 is a sectional view taken along line A-A' in FIG. 9. FIG. 11 is a schematic diagram showing the locations of via holes in an interlayer dielectric layer provided by some embodiments of the present disclosure. FIG. 12 is a schematic diagram showing a semiconductor layer, a first metal layer, a second metal layer and a third metal layer stacked with each other provided by some embodiments of the present disclosure.

Figure 13:
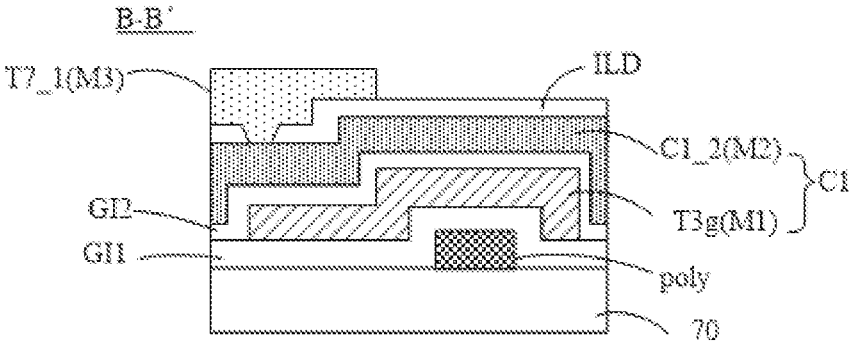
FIG. 13 is a cross-sectional view taken along line B-B' of FIG. 12.
Figure 14:
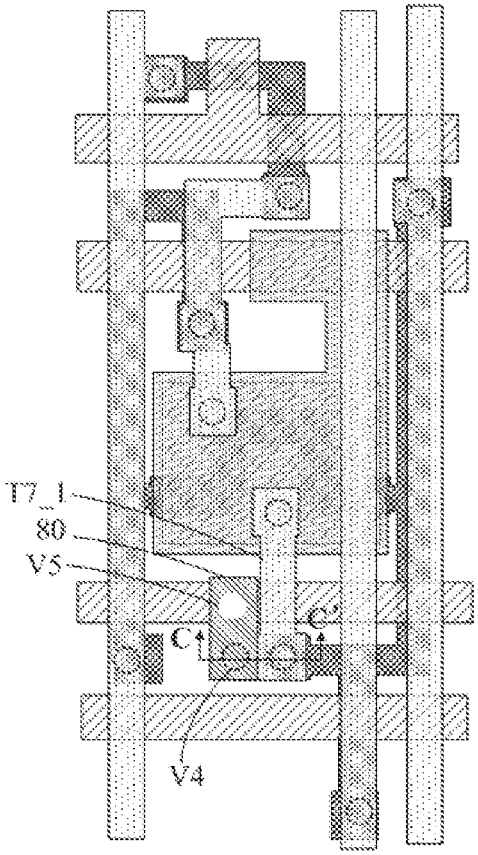
FIG. 14 is a schematic diagram showing a semiconductor layer, a first metal layer, a second metal layer, a third metal layer, and a fifth metal layer stacked with each other provided by some embodiments of the present disclosure.
Figure 15:
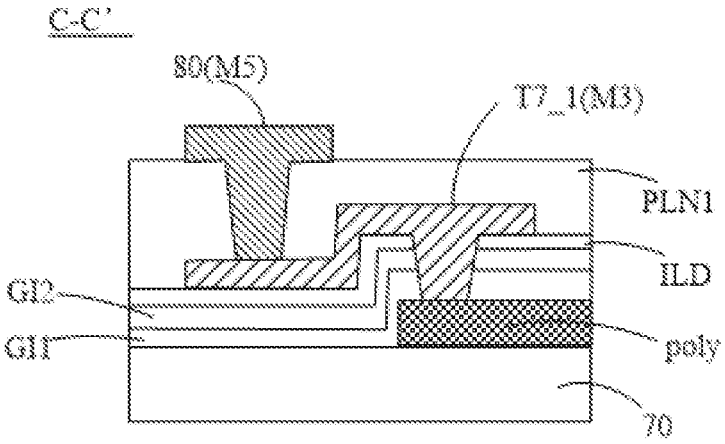
FIG. 15 is a cross-sectional view taken along line C-C' of FIG. 14.

FIG. 13 is a cross-sectional view taken along line B-B' in FIG. 12. FIG. 14 is a schematic diagram showing a semiconductor layer, a first metal layer, a second metal layer, a third metal layer, and a fifth metal layer stacked with each other provided by some embodiments of the present disclosure. FIG. 15 is a cross-sectional view taken along line C-C' in FIG. 14.

As shown in FIG. 13, a semiconductor layer poly is disposed on the substrate 70. A first gate insulation layer GI1 is disposed between the semiconductor layer poly and the first metal layer M1, a second gate insulation layer GI2 is disposed between the first metal layer M1 and the second metal layer M2, and an interlayer dielectric ILD is disposed between the second metal layer M2 and the third metal layer M3. Optionally, the first gate insulation layer GI1, the second gate insulation layer GI2, and the interlayer dielectric layer ILD may be made of an inorganic material such as silicon oxynitride (SiON), silicon oxide (SiOx), or silicon nitride (SiNx).

As shown in FIG. 5 and FIG. 8, a portion of the scan line GATE facing the active layer of the compensation switch transistor T2 serves as the gate electrode of the compensation switch transistor T2. A portion of the light-emitting control line EM facing the active layer of the first control switch transistor T4 serves as the gate electrode of the first control switch transistor T4. The reset switch transistor T6 is a double-gate transistor in which one gate electrode is coupled to the reset line RST and the other gate electrode is a portion of the reset line RST facing the active layer. A portion of the light-emitting control line EM facing the second control switch transistor T5 serves as the gate electrode of the second control switch transistor T5. A portion of the scan line GATE facing the data writing transistor T1 serves as the gate electrode of the data writing transistor T1. A portion of the sensing line Sensing facing the active layer of the sensing switch transistor T7 serves as the gate electrode of the sensing switch transistor T7. In FIG. 8, a position of a gate electrode of a transistor represents the transistor.

As shown in FIG. 9 and FIG. 10, a portion of the scan line GATE overlapping a fourth electrode plate C2_4 serves as a third electrode plate C2_3. The third electrode plate C2_3 and the fourth electrode plate C2_4 serve as two electrode plates of the voltage-stabilizing capacitor C2, respectively. As shown in FIG. 9, FIG. 12 and FIG. 13, the gate electrode T3*g* of the driving transistor serves as the first electrode plate of the storage capacitor C1 and is disposed opposite to a second electrode plate C1_2.

As shown in FIG. 11, the pixel circuit further includes a first via hole V1 and a third via hole V3. The first via hole V1 penetrates through the second gate insulation layer and the interlayer dielectric layer and exposes a portion of the gate electrode T3*g* of the driving transistor. The second via hole V2 in the second electrode plate C2_2 surrounds the first via hole V1, and sidewalls of the second via hole V2 are not in contact or aligned with sidewalls of the first via hole V1. As shown in FIG. 7, FIG. 11 and FIG. 12, the second electrode of the reset switch transistor T6 is coupled to the gate electrode of the driving transistor T3 through the first via hole V1, thereby forming the node N1 in FIG. 2. The third via hole V3 penetrates through the interlayer dielectric layer and exposes a portion of the second electrode plate C2_2 of the storage capacitor, and the first electrode T7_1 of the sensing switch transistor T7 is coupled to the second electrode plate C2_2 of the storage capacitor through the third via hole, thereby forming the node N2 in FIG. 2.

As shown in FIG. 11, the pixel circuit further includes sixth via hole V6 to twelfth via hole V12, each of which penetrates through the interlayer dielectric layer, the first gate insulation layer and the second gate insulation layer. The first electrode of the reset switch transistor T6 is coupled to the active layer through the sixth via hole V6, and the second electrode thereof is coupled to the active layer through the seventh via hole V7. The first electrode of the writing switch transistor T1 is coupled to the active layer thereof through the eighth via hole V8. The first electrode of the sensing switch transistor T7 is coupled to the active layer thereof through the tenth via hole V10, and the second electrode of the sensing switch transistor T7 is coupled to the active layer thereof through the ninth via hole V9. The first electrode of the first control switch transistor T4 is coupled to the active layer thereof through the eleventh via hole V11. The second electrode of the compensation switch transistor T2 is coupled to the active layer thereof through the twelfth via hole V12.

As shown in FIG. 15, a first planarization layer PLN1 is disposed between the third metal layer M3 and the fifth metal layer M5. Optionally, the first planarization layer PLN1 is made of an organic insulating material including, for example, a resin material such as polyimide, epoxy resin, acryl, polyester, photoresist, polyacrylate, polyamide, or siloxane. As shown in FIG. 14 and FIG. 15, a transfer electrode 80 is disposed in the fifth metal layer M5. The first planarization layer PLN1 is formed with a fourth via hole V4 therein, the fourth via hole V4 exposes a portion of the first electrode T7_1 of the sensing switch transistor. The transfer electrode 80 is coupled to the first electrode T7_1 of the sensing switch transistor through the fourth via hole V4.

Figure 16:
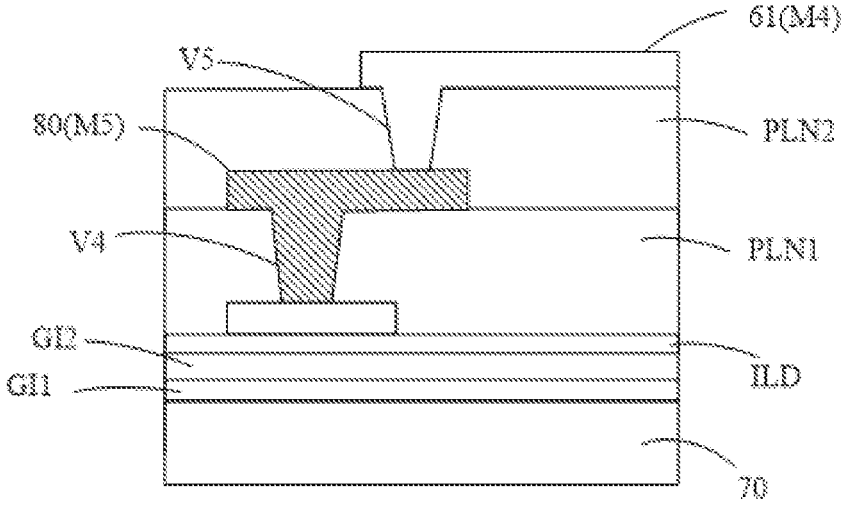
FIG. 16 is a schematic diagram showing a connection between a transfer electrode and a first electrode of a light-emitting device provided by some embodiments of the present disclosure.

FIG. 16 is a schematic diagram showing a connection between the transfer electrode and the first electrode of the light-emitting device provided by some embodiments of the present disclosure. As shown in FIG. 16, a second planarization layer PLN2 is disposed between the fifth metal layer M5 and the fourth metal layer M4. Optionally, the second planarization layer PLN2 is made of an organic insulating material including, for example, a resin material such as polyimide, epoxy, acryl, polyester, photoresist, polyacrylate, polyamide, or siloxane. The second planarization layer PLN2 is formed with a fifth via hole V5 therein, and the first electrode 61 of the light-emitting device is coupled to the transfer electrode 80 through the fifth via hole V5. The arrangement of the transfer electrode 80 can avoid the direct formation of a via hole having a relatively large aperture in the first planarization layer PLN1 and the second planarization layer PLN2, thereby improving the quality of electrical connection of the via hole. In some embodiments, an orthogonal projection of the fourth via hole V4 on the substrate 70 does not overlap an orthogonal projection of the fifth via hole V5 on the substrate 70, thereby improving the reliability of the connection between the first electrode 61 and the transfer electrode 80.

An embodiment of the present disclosure further provides a method for driving the pixel circuit. As shown in FIG. 1, the method includes steps S11 to S23.

At step S11, during the reset sub-period of the sensing period, an active level signal is provided via the reset line RST, such that the voltage signal of the first power line VDD is transmitted to the node N1 through the reset sub-circuit 10. An active level signal is provided via the sensing line Sensing and an initial voltage signal is provided via the reference line REF, such that the initial voltage signal is transmitted to the node N2 through the sensing sub-circuit 50.

At step 12, during the data writing sub-period of the sensing period, an active level signal is provided via the scan line GATE, such that the voltage signal on the data line DATA is transmitted to the second electrode of the driving transistor T3 through the data writing sub-circuit 30, and the first electrode and the gate electrode of the driving transistor T3 are electrically coupled through the threshold compensation sub-circuit 20.

At step S13, during the light-emitting sub-period of the sensing period, an active level signal is provided via each of the sensing line Sensing and the light-emitting control line EM, such that the first power line VDD is electrically coupled to the first electrode of the driving transistor T3 through the light-emitting control sub-circuit 40, the second electrode of the driving transistor T3 is electrically coupled to the second electrode of the light-emitting device 60 through the light-emitting control sub-circuit 40, and the voltage at the node N2 is transmitted to the reference line REF through the sensing sub-circuit 50.

At step S21, during the reset sub-period of the display period, an active level signal is provided via the reset line RST, such that the voltage signal of the first power line VDD is transmitted to the node N1 through the reset sub-circuit 10. An active level signal is provided via the sensing line Sensing and an initial voltage signal is provided via the reference line REF, such that the initial voltage signal is transmitted to the node N2 through the sensing sub-circuit 50.

At step S22, during the data writing sub-period of the display period, an active level signal is provided via the scan line GATE, such that the data voltage signal on the data line DATA is transmitted to the second electrode of the driving transistor T3 through the data writing sub-circuit 30, and the first electrode and the gate electrode of the driving transistor T3 are electrically coupled via the threshold compensation sub-circuit 20.

At step S23, during the light-emitting sub-period of the display period, an active level signal is provided via the light-emitting control line EM, such that the first power line VDD is electrically coupled to the first electrode of the driving transistor T3 through the light-emitting control sub-circuit 40, and the second electrode of the driving transistor T3 is electrically coupled to the second electrode of the light-emitting device 60 through the light-emitting control sub-circuit 40.

The operation processes of the pixel circuit during various sub-periods are described above and is not described herein again.

In an embodiment, the voltage of the data signal during the display period may be compensated by using the voltage at the node N2 read out during the sensing period. For example, during the display period, the voltage of the data signal on the data line may be determined according to a target gray scale and the data voltage compensation value, and the data voltage compensation value may be determined according to the voltage at the node N2 read out by the reference line during the light-emitting sub-period of the sensing period and a preset compensation model. The target gray scale refers to a gray scale of a target image to be displayed during the display period. Exemplarily, the preset compensation model may be a model representing the relationship between the voltage at the node N2 and the data voltage compensation value. By compensating for the voltage of the data signal during the display period, various light-emitting devices can emit light with the same emission luminance in a case where the driving current is the same even if the aging degrees of the various light-emitting devices are different from each other.

An embodiment of the present disclosure further provides a display device, which includes any one of the above pixel circuits. The display device can be any product or component with a display function, such as an OLED panel, a mobile phone, a tablet computer, a television, a display, a notebook computer, a digital photo frame, a navigator and the like.

In the embodiments of the present disclosure, the driving current provided to the light-emitting device from the pixel circuit is independent of the threshold voltage of the driving transistor, thereby improving the display uniformity of the display device. The sensing sub-circuit may sense the voltage at the node N2 and reset the node N2 during various periods, thereby simplifying the entire structure of the display device. In addition, the voltage-stabilizing capacitor can prevent the voltage at the node N2 from obviously jumping at the moment when the light-emitting control sub-circuit is turn on, thereby improving the display effect of the display device.

It should be understood that the above implementations are merely exemplary embodiments for the purpose of illustrating the principles of the present disclosure, however, the present disclosure is not limited thereto. It will be apparent to those skilled in the art that various changes and modifications can be made without departing from the spirit and essence of the present disclosure, which are also to be regarded as the scope of the present disclosure.

What is claimed is:

1. A pixel circuit, comprising: a driving transistor, a storage capacitor, a voltage-stabilizing capacitor, a data writing sub-circuit, a threshold compensation sub-circuit, a reset sub-circuit, a sensing sub-circuit, and a light-emitting control sub-circuit, wherein a first terminal of the storage capacitor, a gate electrode of the driving transistor, a first terminal of the reset sub-circuit, and a first terminal of the threshold compensation sub-circuit are coupled to a first node, and a second terminal of the storage capacitor, a first terminal of the sensing sub-circuit, and a first electrode of the light-emitting device are coupled to a second node;

the reset sub-circuit is configured to transmit a voltage signal on a first power line to the first node in response to control of a reset line;

the sensing sub-circuit is configured to transmit an initial voltage signal on a reference line to the second node in response to control of a sensing line during a reset sub-period of a sensing period and a reset sub-period of a display period; and to transmit a voltage at the second node to the reference line in response to control of the sensing line during a light-emitting sub-period of the sensing period, so as to read the voltage at the second node;

the threshold compensation sub-circuit is configured to electrically couple a first electrode and the gate electrode of the driving transistor in response to control of a scan line, so as to write a threshold voltage of the driving transistor into the storage capacitor;

the data writing sub-circuit is configured to transmit a data signal on a data line to a second electrode of the driving transistor in response to control of the scan line;

the light-emitting control sub-circuit is configured to, in response to control of a light-emitting control line, electrically couple a first electrode of the driving transistor and the first power line, and to electrically couple the second electrode of the driving transistor and the light-emitting device;

two terminals of the voltage-stabilizing capacitor are respectively coupled to the second node and the scan line;

each of the data writing sub-circuit, the threshold compensation sub-circuit, the reset sub-circuit, the sensing sub-circuit and the light-emitting control sub-circuit comprises at least one switch transistor, and the at least one switch transistor, the driving transistor, the storage capacitor and the voltage-stabilizing capacitor are respectively in a semiconductor layer, a first metal layer, a second metal layer and a third metal layer stacked in sequence, spaced apart and insulated from each other, the first electrode of the light-emitting device is in a fourth metal layer, and the fourth metal layer is on a side of the third metal layer away from the second metal layer;

the storage capacitor comprises a first electrode plate and a second electrode plate disposed opposite to each other, and at least a portion of the first electrode plate serves as a portion of the gate electrode of the driving transistor; and the voltage-stabilizing capacitor comprises a third electrode plate and a fourth electrode plate disposed opposite to each other, and at least a portion of the third electrode plate is in a same layer as the scan line.

2. The pixel circuit of claim 1, wherein the at least one switch transistor in the emission control sub-circuit comprises: a first control switch transistor and a second control switch transistor, wherein a gate electrode of the first control switch transistor is coupled to the light-emitting control line, a first electrode of the first control switch transistor is coupled to the first power line, a second electrode of the first control switch transistor is coupled to the first electrode of the driving transistor, a gate electrode of the second control switch transistor is coupled to the light-emitting control line, a first electrode of the second control switch transistor is coupled to the second electrode of the driving transistor, and a second electrode of the second control switch transistor serves as the first terminal of the light-emitting control sub-circuit.

3. The pixel circuit of claim 1, wherein the at least one switch transistor in the data writing sub-circuit comprises a writing switch transistor, a gate electrode of the writing switch transistor is coupled to the scan line, a first electrode of the writing switch transistor is coupled to the data line, and a second electrode of the writing switch transistor is coupled to the second electrode of the driving transistor.

4. The pixel circuit of claim 1, wherein the driving transistor and all of the switch transistors are N-type transistors.

5. A display device comprising the pixel circuit of claim 1.

6. The pixel circuit claim 1, wherein the at least one switch transistor in the threshold compensation sub-circuit comprises a compensation switch transistor, a gate electrode of the compensation switch transistor is coupled to the scan line, a first electrode of the compensation switch transistor is coupled to the first electrode of the driving transistor, and a second electrode of the compensation switch transistor serves as the first terminal of the threshold compensation sub-circuit.

7. The pixel circuit of claim 6, wherein the threshold compensation switch transistor is a double-gate transistor.

8. The pixel circuit of claim 1, wherein the second electrode plate of the storage capacitor and the fourth electrode plate of the voltage-stabilizing capacitor are in a same layer and made of a same material.

9. The pixel circuit of claim 8, wherein the second electrode plate of the storage capacitor and the fourth electrode plate of the voltage-stabilizing capacitor are in the second metal layer.

10. The pixel circuit of claim 1, wherein the sensing line and the scan line are in a same layer and made of a same material, and the reference line and the data line are in a same layer and made of a same material.

11. The pixel circuit of claim 10, wherein the sensing line and the scan line are in the first metal layer, and the reference line and the data line are in the third metal layer.

12. A method for driving the pixel circuit of claim 1, comprising:

during the reset sub-period of the sensing period and the reset sub-period of the display period, providing, via the reset line, an active level signal such that the voltage signal on the first power line is transmitted to the first node through the reset sub-circuit; and providing, via the sensing line, an active level signal and providing, via the reference line, an initial voltage signal such that the initial voltage signal is transmitted to the second node through the sensing sub-circuit;

during a data writing sub-period of the sensing period and a data writing sub-period of the display period, providing, via the scan line, an active level signal such that the data signal on the data line is transmitted to the second electrode of the driving transistor through the data writing sub-circuit, and the first electrode and the gate electrode of the driving transistor are electrically coupled through the threshold compensation sub-circuit;

during a light-emitting sub-period of the sensing period, providing, via both of the sensing line and the light-emitting control line, an active level signal, such that the first power line and the first electrode of the driving transistor are electrically coupled through the light-emitting control sub-circuit, the second electrode of the driving transistor and the light-emitting device are electrically coupled through the light-emitting control sub-circuit, and a voltage at the second node is transmitted to the reference line through the sensing sub-circuit; and during a light-emitting sub-period of the display period, providing an active level signal via the light-emitting control line, such that the first power line and the first electrode of the driving transistor are electrically coupled through the light-emitting control sub-circuit, and the second electrode of the driving transistor and the light-emitting device are electrically coupled through the light-emitting control sub-circuit.

13. The method of claim 12, wherein, during the display period, a voltage of the data signal on the data line is determined according to a target gray scale and a data voltage compensation value, and the data voltage compensation value is determined according to a voltage read out by the reference line during the light-emitting sub-period of the sensing period and a preset compensation model.

14. The pixel circuit of claim 1, further comprising: a first gate insulation layer, a second gate insulation layer, an interlayer dielectric layer, and a first planarization layer, wherein the first gate insulation layer is between the semiconductor layer and the first metal layer, the second gate insulation layer is between the first metal layer and the second metal layer, the interlayer dielectric layer is between the second metal layer and the third metal layer, and the first planarization layer is between the third metal layer and the fourth metal layer.

15. The pixel circuit of claim 14, wherein the at least one switch transistor in the reset sub-circuit comprises a reset switch transistor, a gate electrode of the reset switch transistor is coupled to the reset line, a first electrode of the reset switch transistor is coupled to the first power line, and a second electrode of the reset switch transistor serves as the first terminal of the reset sub-circuit.

16. The pixel circuit of claim 15, further comprising: a first via hole penetrating through the second gate insulation layer and the interlayer dielectric layer and exposing a portion of the gate electrode of the driving transistor; and a second via hole in the second electrode plate of the storage capacitor and surrounding the first via hole, wherein no sidewall of the second via hole is in contact with a sidewall of the first via hole, and an active layer of the reset switch transistor is in the semiconductor layer, each of a first electrode and a second electrode of the reset switch transistor is in the third metal layer, and the second electrode of the reset switch transistor is coupled to the gate electrode of the driving transistor through the first via hole, so as to form the first node.

17. The pixel circuit of claim 14, wherein the at least one switch transistor in the sensing sub-circuit comprises a sensing switch transistor, a gate electrode of the sensing switch transistor is coupled to the sensing line, a first electrode of the sensing switch transistor serves as the first terminal of the sensing sub-circuit, and a second electrode of the sensing switch transistor is coupled to the reference line.

18. The pixel circuit of claim 17, further comprising a third via hole penetrating through the interlayer dielectric layer and exposing a portion of the second electrode plate of the storage capacitor, wherein each of the first and second electrodes of the sensing switch transistor is in the third metal layer, and the first electrode of the sensing switch transistor is coupled to the second electrode plate of the storage capacitor through the third via hole, so as to form the second node.

19. The pixel circuit of claim 18, further comprising a transfer electrode in a fifth metal layer between the first planarization layer and the fourth metal layer; and a second planarization layer between the fifth metal layer and the fourth metal layer, wherein the first planarization layer is formed with a fourth via hole therein, the fourth via hole exposing a portion of the first electrode of the sensing switch transistor, the second planarization layer is formed with a fifth via hole therein, the fifth via hole exposing a portion of the transfer electrode, the first electrode of the light-emitting device is coupled to the transfer electrode through the fifth via hole, and the transfer electrode is coupled to the first electrode of the sensing switch transistor through the fourth via hole.

20. The pixel circuit of claim 19, wherein an orthographic projection of the fourth via hole on a substrate does not overlap with an orthographic projection of the fifth via hole on the substrate.

* * * * *